US006354522B2

(12) United States Patent
Iwata et al.

(10) Patent No.: US 6,354,522 B2
(45) Date of Patent: Mar. 12, 2002

(54) ELECTROSTATIC SPRAYER

(75) Inventors: Masao Iwata; Kiyoshige Enomoto, both of Yokosuka; Yoshiaki Hironaka, Sayama; Shunsuke Nakamura, Tokyo, all of (JP)

(73) Assignees: Oppama Industry Co., Ltd., Kanagawa-ken (JP); Kioritz Corporation, Tokyo (JP)

( * ) Notice: Subject to any disclaimer, the term of this patent is extended or adjusted under 35 U.S.C. 154(b) by 0 days.

(21) Appl. No.: 09/835,442

(22) Filed: Apr. 17, 2001

(30) Foreign Application Priority Data

Apr. 20, 2000 (JP) ..... 2000-119218

(51) Int. Cl.[7] ..... B05B 5/00

(52) U.S. Cl. ..... 239/690; 239/101; 239/706; 239/707; 239/708

(58) Field of Search ..... 239/101, 690, 239/706, 707, 708

(56) References Cited

U.S. PATENT DOCUMENTS 3,731,145 A * 5/1973 Senay ..... 239/DIG. 14
3,815,829 A * 6/1974 Gould, III ..... 239/102
3,841,264 A * 10/1974 Masuda ..... 239/706 X
4,598,871 A * 7/1986 Hartle ..... 239/690
4,785,372 A * 11/1988 Hosono et al.
4,934,607 A * 6/1990 Lasley ..... 239/691
5,187,635 A * 2/1993 Yehl

* cited by examiner

*Primary Examiner*—Robin O. Evans
(74) *Attorney, Agent, or Firm*—Michael D. Bednarek; Shaw Pittman LLP

(57) ABSTRACT

In an electrostatic sprayer, a pulsating voltage developed using a battery or a generator as a power supply is stepped up using a step-up transformer. A resultant high-voltage pulse is rectified and applied to an electrostatic electrode. A spray jetted from a spray nozzle is thus electrified. Herein, the step-up transformer is located near the spray nozzle. Owing to this structure, a high voltage produced by the step-up transformer can be applied to the electrostatic electrode with a loss minimized.

3 Claims, 3 Drawing Sheets

ELECTROSTATIC SPRAYER

BACKGROUND OF THE INVENTION

1. Field of the Invention

The present invention relates to an electrostatic sprayer for electrifying a sprayed agricultural chemical or any other chemical and scattering the chemical over a cultivated plant or the like.

2. Description of the Related Art

Electrostatic sprayers having electrostatic electrodes located in front of the outlets of spray nozzles have been put to use in the past. The electrostatic electrodes are used to electrify sprays jetted from the spray nozzles. Using the electrostatic sprayer, since sprays jetted from the spray nozzles are electrified, the sprays highly efficiently adhere to a field crop or the like whose polarity is opposite to that of the sprayed particles of a chemical. This leads to improved certainty of control.

The electrostatic sprayer has an electrostatic circuit like the one shown in FIG. 3 or FIG. 4 included in a sprayer body. In the electrostatic circuit shown in FIG. 3, a transistor 3 connected to a battery 1 is driven with a pulse output from a trigger circuit 2 that is driven using the battery 1 as a power supply. A pulsating voltage output from the transistor 3 is stepped up using a step-up transformer 4. Consequently, a high voltage is applied to an electrostatic electrode 6 via a rectifier diode 5. Incidentally, a triggering voltage output circuit or an oscillatory circuit is adopted as the trigger circuit 2. The triggering voltage output circuit 2 outputs a triggering voltage which a trigger coil induces synchronously with rotation of an internal combustion engine.

Furthermore, in the electrostatic circuit shown in FIG. 4, a voltage developed by a battery 1 is converted into a direct voltage of a predetermined level by means of a DC—DC converter 7. The direct voltage is applied to a charge/discharge capacitor 9 via a reverse-current prevention diode 8 and a primary winding 4*a* of a step-up transformer 4, whereby the charge/discharge capacitor 9 is charged. Meanwhile, a thyristor 10 becomes conducting with a pulse output from a trigger circuit 2 that is driven using the battery 1 as a power supply. Charge in the charge/discharge capacitor 9 is supplied to the primary winding 4*a* of the step-up transformer 4 via the thyristor 10. A high-voltage pulse induced in the secondary winding 4*b* is applied to an electrostatic electrode 6 via a rectifier diode 5.

In general, the electrostatic sprayer has a nozzle boom 11, to which a plurality of spray nozzles 12 is coupled, incorporated together with a chemical tank and the battery 1 on a movable sprayer body. A high-voltage 20 cable to which the step-up transformer 4 and rectifier diode 5 are coupled is extended along the nozzle boom 11, whereby a high direct voltage is applied to each electrostatic electrode 6 located in front of each of the spray nozzles 12.

However, in the conventional electrostatic sprayer, the high-voltage cable 20 is extended from the step-up transformer 4 located on a high-voltage pulse generation stage to the vicinity of each spray nozzle 12. The high-voltage cable 20 is so long that a high voltage stepped up by the step-up transformer 4 largely drops by the time that the high voltage reaches each electrostatic electrode 6 because of a resistance loss caused by the so long high-voltage cable 20. The number of electrostatic electrodes 6 capable of being connected to one step-up transformer 4 is therefore limited. Moreover, a voltage leakage may occur along the way of the high-voltage cable 20. Efficiency in electrifying a spray may deteriorate due to a drop of a voltage to be applied to the electrostatic electrode 6.

SUMMARY OF THE INVENTION

An object of the present invention is to provide an electrostatic sprayer capable of highly efficiently applying a high voltage produced by a step-up transformer to an electrostatic electrode with a loss minimized.

For accomplishing the above object, in an electrostatic sprayer in accordance with the present invention, a pulsating voltage developed using a battery or a generator as a power supply is stepped up using a step-up transformer. The resultant high-voltage pulse is rectified and applied to an electrostatic electrode located near a spray nozzle. Thus, a spray jetted from the spray nozzle is electrified. The step-up transformer is located near the spray nozzle.

According to the present invention, the length of a high-voltage cable from the step-up transformer to the electrostatic electrode is so short as to minimize the adverse effect of a resistance caused by the excessively long high-voltage cable. Consequently, the resultant high voltage is highly efficiently applied to the electrostatic electrode.

In a preferred embodiment of the present invention, at least part of the spray nozzle may be used as a core of the step-up transformer. In this case, the step-up transformer itself and the electrostatic electrode can be confined to the smallest possible sizes.

DESCRIPTION OF THE PREFERRED EMBODIMENTS

Figure 1:
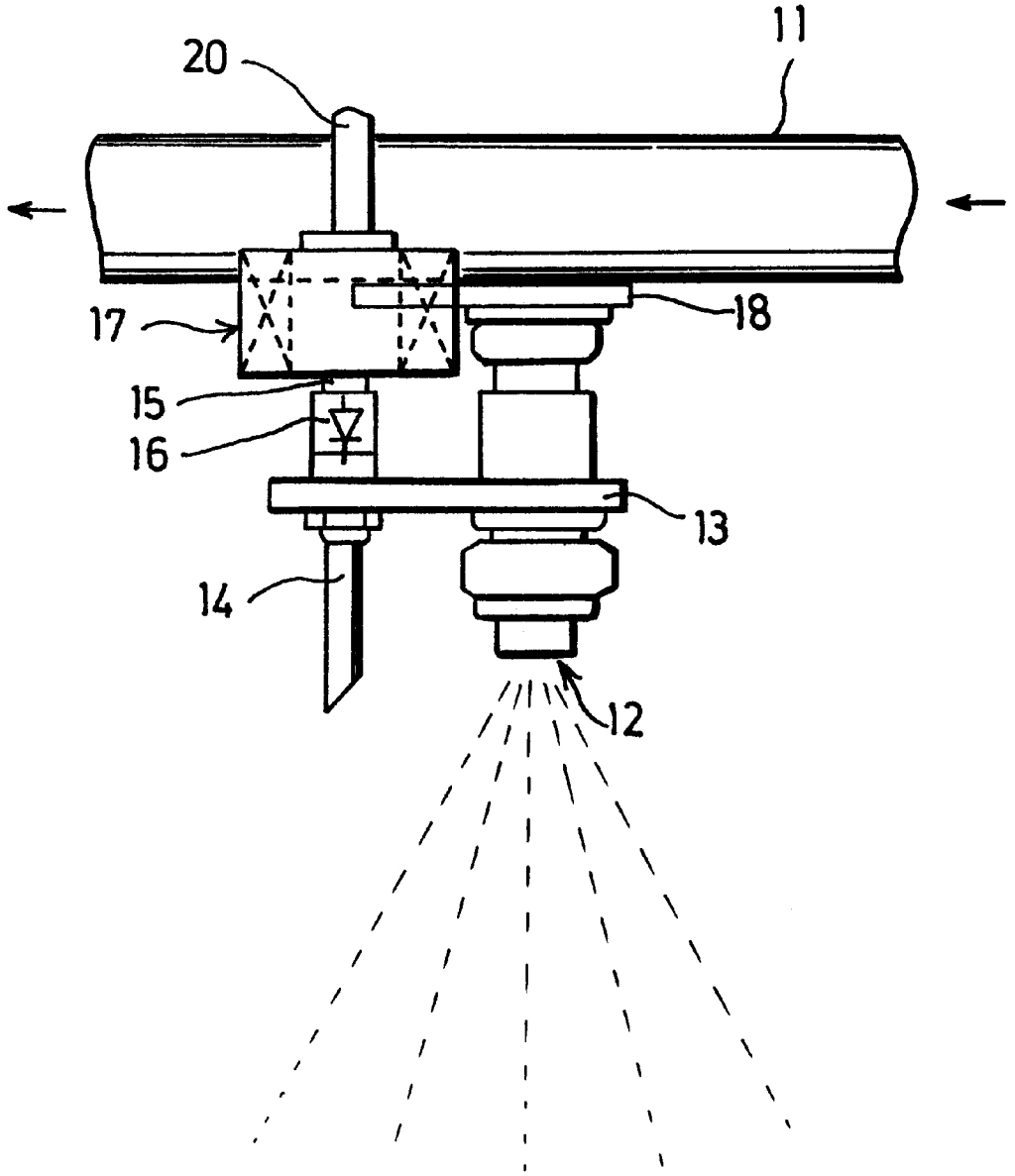
FIG. 1 is a front view showing a major portion of an electrostatic sprayer in accordance with an embodiment of the present invention.

Referring to FIG. 1, a nozzle boom 11 is used to feed an agricultural liquid chemical pumped from a chemical tank (not shown) to a plurality of spray nozzles 12. The plurality of spray nozzles 12 is coupled to the nozzle boom 11 at predetermined intervals. Moreover, an electrode supporting plate 13 is included as part of each spray nozzle 12. The electrode supporting plate 13 supports an electrostatic electrode 14 so that the electrostatic electrode 14 will adjoin each spray nozzle 12. The distal end of the electrostatic electrode 14 opens on the tip of the spray nozzle 12 and is obliquely cut for better drainage.

Moreover, a secondary winding (not shown) of a step-up transformer 17 located near the spray nozzle 12 is connected to the electrostatic electrode 14 by way of a nozzle high-voltage cable 15 with minimal length and a rectifier diode 16. The step-up transformer 17 is held by, for example, a bracket 18 attached to the spray nozzle 12.

A chemical pumped through the nozzle boom 11 is jetted from the tip of each spray nozzle 12. Concurrently, a relatively low pulsating voltage output from the aforesaid transistor 3 or charge/discharge capacitor 9 is stepped up by the step-up transformer 17 located near the electrostatic electrode 14, and converted into a high direct voltage by the rectifier diode 16. The resultant pulsating high direct voltage is applied to the electrostatic electrode 14. Consequently, the particles of the chemical sprayed from the spray nozzle 12 are electrified due to the electrostatic electrode 14. The chemical therefore efficiently adheres to a cultivated plant or the like.

In the present embodiment, the step-up transformer 17 is located near the electrostatic electrode 14 via a low-voltage cable 20. Therefore, the nozzle high-voltage cable 15 that is electrically connecting the step-up transformer 17 and electrostatic electrode 14 can be designed to have a minimal length. Consequently, a voltage loss caused by the nozzle high-voltage cable 15 can be minimized, and a high direct voltage resulting from stepping up can be utilized effectively. Moreover, the low-voltage cable 20 coupled to the primary winding (low-voltage terminal) of the step-up transformer 17 is routed along the nozzle boom 11 to run near the plurality of spray nozzles 12. Compared with the conventional sprayer in which the high-voltage cable is routed along the nozzle boom in order to distribute a high voltage to the electrostatic electrodes, higher safety is guaranteed.

Figure 2:
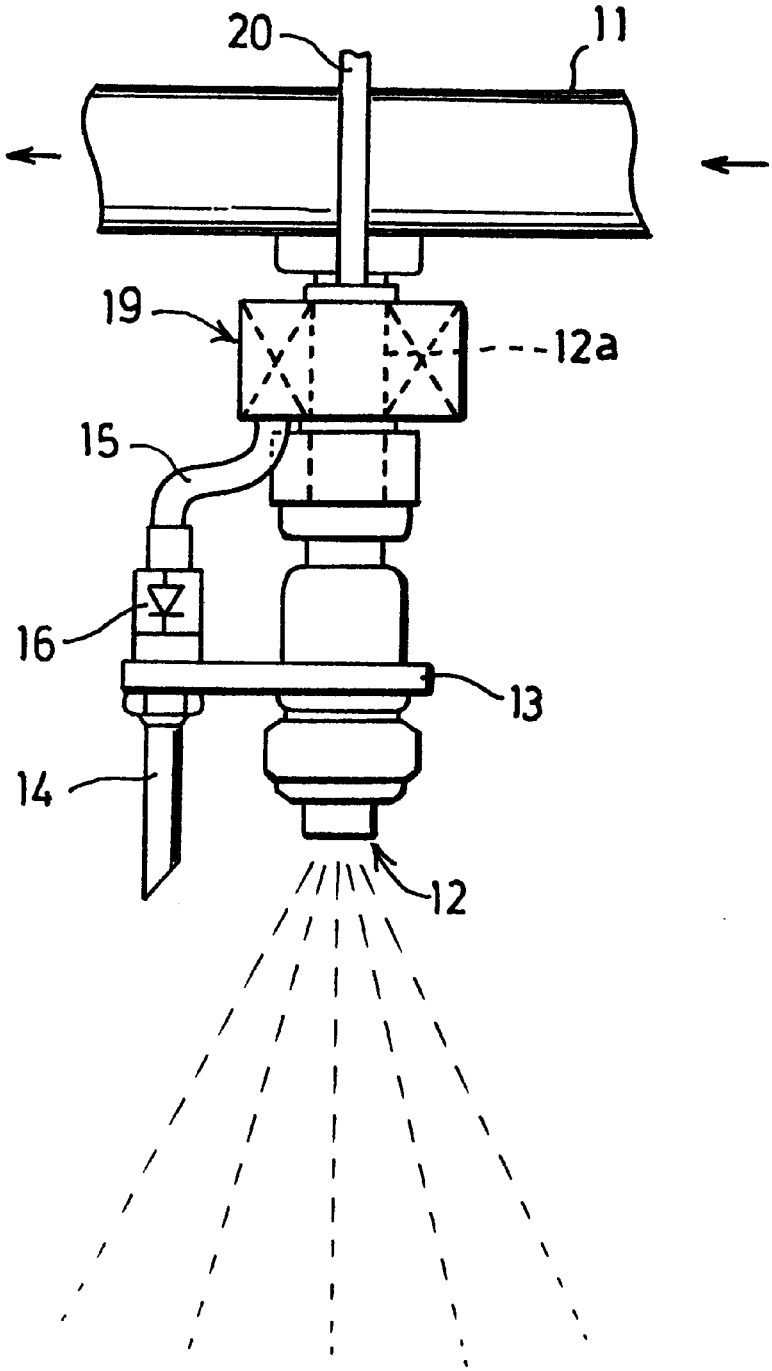
FIG. 2 is a front view showing a major portion of an electrostatic sprayer in accordance with another embodiment of the present invention.

FIG. 2 shows another embodiment of the present invention. In the present embodiment, a step-up transformer 19 is structured to use a magnetic member, which forms at least part of a spray nozzle 12, for example, a nipple member 12*a* as a core thereof. The secondary winding of the step-up transformer 19 is connected to an electrostatic electrode 14 via a rectifier diode 16. More particularly, for example, annular primary and secondary windings devoid of a core are attached to the nipple member 12*a* so that they will enclose the nipple member 12*a*.

According to the present embodiment, a high-voltage cable 15 extending from the step-up transformer 19 to the electrostatic electrode 14 can be designed to have a minimal length. In addition, the step-up transformer 19 need not have a specific core. Compared with the step-up transformer 17 shown in FIG. 1, the step-up transformer 19 shown in FIG. 2 can be designed compactly to have a small size.

Figure 3:
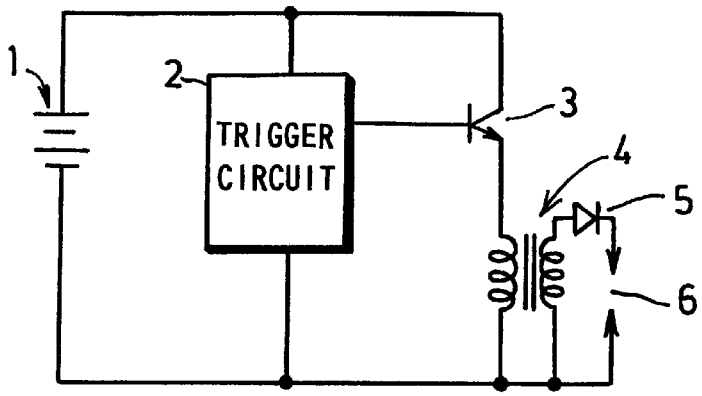
Fig. 3 Prior Art
FIG. 3 is a circuit diagram showing an electrostatic circuit employed in a conventional electrostatic sprayer.
Figure 4:
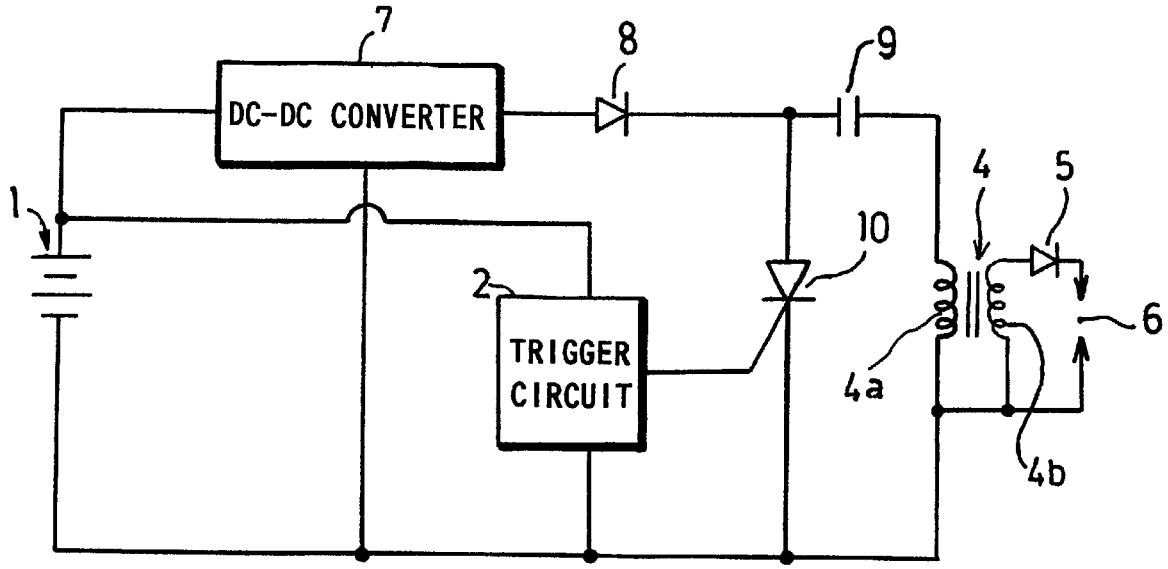
Fig. 4 Prior Art
FIG. 4 is a circuit diagram showing another electrostatic circuit employed in a conventional electrostatic sprayer.

In either of the embodiments, a plurality of step-up transformers may be included for one spray nozzle in order to improve an electrostatic effect. Moreover, a pulsating voltage may be applied to the primary winding of the step-up transformer 17 or 19 in the same manner as it conventionally is according to the trigger system described with reference to FIG. 3 and FIG. 4.

What is claimed is:

1. An electrostatic sprayer comprising: a power supply for supplying a pulsating voltage; a set-up transformer for stepping up the pulsating voltage developed using the power supply; a rectifier for rectifying the high-voltage pulse; a spray nozzle; and an electrostatic electrode to which the rectified high-voltage pulse is applied, the electrostatic electrode being located near the spray nozzle, whereby a spray jetted from said spray nozzle is thus electrified, and said set-up transformer is located near said spray nozzle, wherein at least part of said spray nozzle acts as a core of said step-up transformer.

2. The electrostatic sprayer of claim 1, wherein the power supply is a battery.

3. The electrostatic sprayer of claim 1, wherein the power supply is a generator.

* * * * *